United States Patent [19]

Rosink

[11] 4,432,118

[45] Feb. 21, 1984

[54] SLIVER COILER

[75] Inventor: Albert Rosink, Nordhorn, Fed. Rep. of Germany

[73] Assignee: Trutzschler GmbH & Co. KG, Mönchen-Gladbach, Fed. Rep. of Germany

[21] Appl. No.: 357,674

[22] Filed: Mar. 12, 1982

[30] Foreign Application Priority Data

Mar. 18, 1981 [DE] Fed. Rep. of Germany ..... 3110440

[51] Int. Cl.[3] ..... B65H 54/80

[52] U.S. Cl. ..... 19/159 R

[58] Field of Search ..... 19/159 R, 159 A; 68/177; 100/82

[56] References Cited

U.S. PATENT DOCUMENTS

| | | | |
|---|---|---|---|
| 2,404,742 | 7/1946 | Polak et al. | 19/159 R |
| 2,695,429 | 11/1954 | Howes et al. | 19/159 R |
| 2,700,797 | 2/1955 | Robinson | 19/159 R |
| 2,820,255 | 1/1958 | Kaiser | 19/159 R |
| 2,908,945 | 10/1959 | Carmichael | 19/159 R |
| 3,299,479 | 1/1967 | Nivens | 19/159 R |
| 3,323,179 | 6/1967 | Gossett et al. | 19/159 R |
| 4,228,563 | 10/1980 | Weber | 19/159 R |

*Primary Examiner*—Louis Rimrodt

*Attorney, Agent, or Firm*—Spencer & Frank

[57] ABSTRACT

A sliver coiler for a carding machine or the like includes a can having an open top; a support for positioning the can in a generally upright orientation; a rotary head having a guide arranged eccentrically with respect to the axis of rotation of the rotary head. The central axis of the can is spaced from the axis of rotation of the rotary head, whereby during rotation of the rotary head and the can, the rotary head deposits sliver in the can in superposed continuous circular loops which are eccentric with respect to the central axis of the can. There is provided an adjusting arrangement for arbitrarily altering the distance between the central axis of the can and the axis of rotation of the rotary head for effecting contact between outer parts of the circular loops and inner wall faces of the can irrespective of the thickness of the sliver deposited in the coiler.

7 Claims, 7 Drawing Figures

SLIVER COILER

BACKGROUND OF THE INVENTION

This invention relates to a fiber sliver coiler associated with a carding machine, a drawing frame or the like. The coiler has a rotary head mounted in a machine frame and having a rotary disc, by means of which, during normal operation, a fiber sliver is deposited in a can rotatably positioned underneath the rotary head.

Fiber slivers of man-made fibers such as acrylic are of a fluffy consistency and therefore are somewhat thicker than cotton slivers. While the can is filled to the wall during the processing of man-made fibers, after switching to cotton processing, between the can wall and the stacked sliver layers a free space may remain. This means that the can has not been completely filled which is a disadvantageous occurrence. It is a further disadvantage that the layered sliver filling in the can shifts which may result in the fluctuation of the sliver number.

SUMMARY OF THE INVENTION

It is an object of the invention to provide an improved sliver coiler of the above-outlined type which provides for a complete filling of the can up to its wall regardless of whether man-made fiber sliver or cotton fiber sliver is handled by the coiler.

This object and others to become apparent as the specification progresses, are accomplished by the invention, according to which, briefly stated, at the height level of the plane where the sliver enters the can, the center (central axis) of the can is radially slightly offset with respect to the center (axis of rotation) of the rotary disc such that the radially outermost points where the sliver is deposited are adjacent the inner wall of the can.

By displacing the center point of the can relative to the center point of the rotary disc, that is, by shifting the can itself with respect to the locally stationary rotary disc, the wall of the can is moved closer to the radially outermost-located deposition point of the sliver. Such a setting is effected expediently at the beginning of the fiber processing. It may, however, be necessary to effect a correction during the processing itself which is also provided for by the invention. Thus, it is ensured that the can, even in case of a switchover from the processing of man-made fiber to the processing of cotton or conversely, is filled to the wall, as a result of which the superimposed deposited sliver layers are in engagement with the can wall. Furthermore, the invention prevents the sliver from undergoing an undesired number change as a result of oscillating motions which may occur during turning of the can or during transportation.

Preferably, the can is supported such that it is shiftable radially with respect to the central can axis. For this purpose, a rotatable base plate for the can is displaceable in the horizontal direction. Expediently, the bracket for the base plate bearing has a slot and positions a transmission element, for example, a drive belt, on a tensioning roller.

According to another preferred embodiment of the invention, the can is supported for tilting motion, whereby the inclination of the central can axis is altered with respect to the rotary axis of the coiler head (rotary head). Preferably, the plane of the rotary base plate for the can is arranged at an angle with respect to the plane of the rotary disc. Expediently, such an arrangement is effected by providing that the plane of the base plate bearing is arranged at an angle to the plane of the rotary disc. According to a further advantageous feature of the invention, a cross-sectionally wedge-shaped apertured disc is disposed between the fixed outer race of the bearing and the countersupport for the bearing.

DESCRIPTION OF THE PREFERRED EMBODIMENTS

Figure 1:
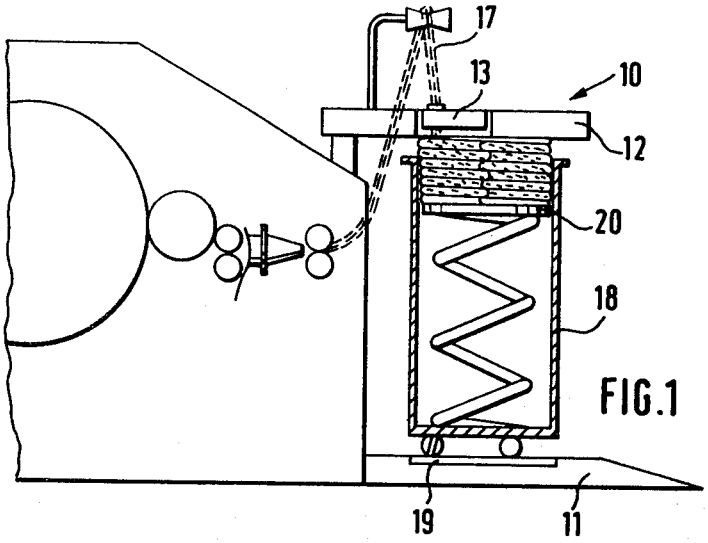
FIG. 1 is a schematic side elevational view, partially in section, of a sliver coiler incorporating the invention.
Figure 1A:
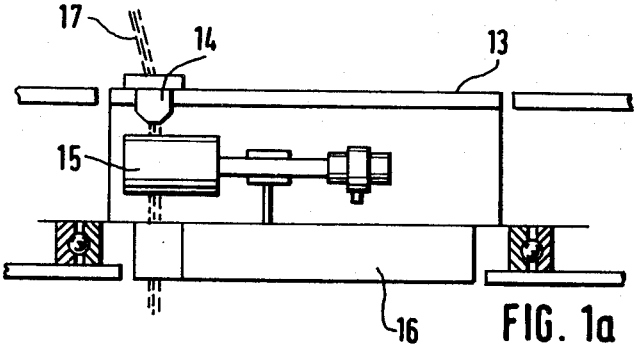
FIG. 1*a* is an elevational view of a detail of FIG. 1 on an enlarged scale.

Turning to FIG. 1, there is illustrated in section a sliver coiler generally designated at 10. The machine frame for the coiler 10 comprises an elongated foot plate 11 and a head plate 12. The horizontally extending plates 11 and 12 are superposed and vertically spaced. The head plate 12 carries a rotary head 13 which comprises a trumpet 14, feed rolls 15 and a rotary disc 16 which is rotatable about a vertical rotary axis and the underside of which is substantially coplanar with the underside of the head plate 12, as it may be best observed in FIG. 1*a*. During normal operation of the coiler 10, the feed rollers 15 are driven in such a manner that the sliver 17 passing through the trumpet 14 held in the rotary head 13, is deposited in a can 18 placed over the foot plate 11 underneath the rotary head 13 and the head plate 12. The foot plate 11 supports a rotary bottom plate 19 to impart a rotary motion to the can 18 resting thereon when the sliver 17 is deposited in the can 18 by the rotary head 13.

The can 18 has a planar underside which may be provided with rollers. The bottom 20 of the can 18 is either stationary or is a vertically movable platform. In the latter case the fiber sliver 17 introduced into the can 18 projects upwardly beyond the open upper end of the can 18 and engages the substantially flat underside of the head plate 12 and the rotary disc 16 during the major part of the can filling operation as well as subsequent to the filling of the can 18.

In case the can 18 has a stationary bottom, subsequent to the filling of the can 18, the deposited sliver 17 projects beyond the upper side of the can and is pressed against the underface of the head plate 12 and the rotary disc 16. Thus, after filling the can 18, the deposited sliver projects in any event beyond the upper face of the can 18 as shown in solid lines in FIG. 1. As a result, the deposited fiber sliver, by virtue of the inherent elasticity of the sliver and/or by virtue of the bias of the movable bottom 20 is pressed against the underface of the head plate 12 and the rotary disc 16. In case no pressure force is exerted from above on the sliver 17 deposited in the can 18, the fiber sliver 17 projects to a greater extent beyond the open upper side of the can 18. This is, for example, the case when the can 18 is transported, if, during can replacement, the filled can 18 is, from the position underneath the rotary head 13 moved away from the base plate 11.

Figure 1B:
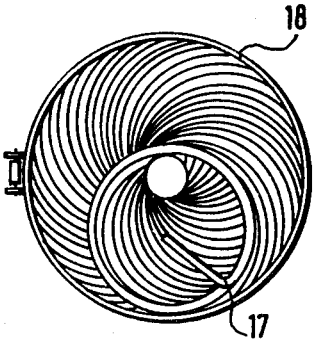
FIG. 1*b* is a top plan view of a coiler can with sliver filling.
Figure 2:
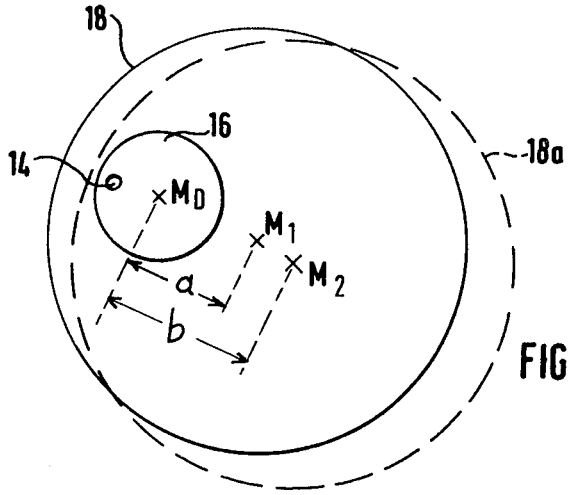
FIG. 2 is a schematic top plan view of coiler components according to the invention, illustrating geometrical relationships.

As shown in FIGS. 1 and 1*b*, the sliver loops stacked on one another within the can 18 on the bottom 20 lie along their outermost circumferential portion on the inner wall of the can 18. In this case, when, for example, man-made fibers are processed, the center point $M_1$ of the can 18 as shown in FIG. 2 assumes a predetermined distance a from the center $M_D$ of the rotary head 13 (or rotary disc 16). The center point $M_1$ is one point of the central longitudinal axis of the can 18 and is situated at about the height level of the open top of the can 18. Similarly, the center point $M_D$ is one point of the rotary axis of the rotary head 13 and is situated at the same height level as the point $M_1$. The outline of the can 18 associated with the center point $M_1$ is shown in solid lines in FIG. 2. If, subsequently, cotton fibers are processed which by nature, are thinner than the man-made fibers, the outermost circumferential points of the deposited fiber sliver loops do no longer engage the inner wall of the can 18 whose center is at a distance a from the center of the rotary disc 16. Thus, there is an intermediate space between the sliver loops and the inner wall of the can 18. Such an occurrence takes place also because the distance of the trumpet 14 from the inner wall of the can 18 is the same in both instances.

According to the invention, the center point $M_1$ of the can 18 is displaced with respect to the stationary center point $M_D$ of the rotary disc 16 in the radial direction from $M_1$ to $M_2$ which is at a distance b from the center $M_D$ of the rotary disc 16. In its new position the outline of the can 18 is shown in phantom lines 18*a*. As a result of this shift, upon processing the thinner cotton fiber slivers, the radially outermost circumferential points of the sliver will, as in case of thicker man-made fibers, lie at the inner wall of the can 18*a*, since the distance of the trumpet 14 from the inner wall of the can 18*a* has been reduced.

Figure 3:
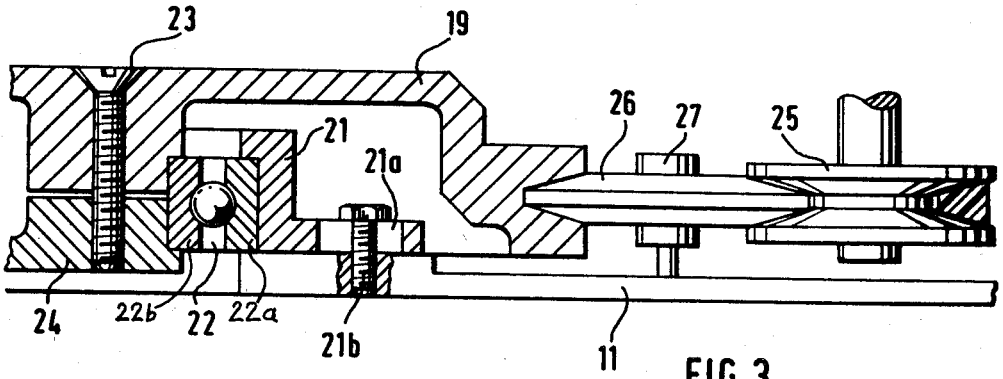
FIG. 3 is a fragmentary sectional elevational view of a preferred embodiment of the invention.

A preferred embodiment of the invention for effecting an adjustment of the distance between the central axis of the can 18 and the axis of rotation of the rotary head 13 (or rotary disc 16) is illustrated in FIG. 3. The can 18 (not shown in FIG. 3) is supported on and rotated by the base plate 19 which is rotatably supported on the foot plate 11 attached to the ground or, as the case may be, forming part of a machine frame. To the center zone of the underside of the base plate 19 there is affixed a base block 24 by means of screws 23 (only one shown). The base plate 19 is rotatably supported on the foot plate 11 by means of a rotary bearing assembly formed of a roller bearing 22 and a bearing bracket 21. The base plate 19 is rotated by a drive belt 26 trained about the rim of the base plate 19 and about a drive pulley 25. A roller 27 supported on the foot plate 11 is in engagement with the drive belt 26 to impart the appropriate tension thereto. The can 18 is positioned in an upright orientation on the top surface of the base plate 19 in a conventional manner for rotation about its central axis, in unison with the rotation of the base plate 19.

The ball bearing 22 has an inner race 22*b* in engagement with a hub portion of the base plate 19 and an outer race 22*a* which, in turn, is in engagement with an inner face of the bearing bracket 21.

According to the invention, the bearing bracket 21 is linearly adjustably supported on the foot plate 11. For this purpose the mounting flange portion of the bracket 21 has a slot 21*a* through which a securing screw 21*b* passes. The securing screw 21*b* is threadedly held in the foot plate 11. For practical purposes there may be provided a plurality of parallel-oriented slots 21*a* with associated securing screws 21*b*. For a relatively thick sliver, such as a sliver of man-made fibers, the bearing assembly 21, 22 and thus the base plate 19 will be so adjusted by sliding the bracket 21 in the foot plate 11 as permitted by the slot and screw assembly 21*a*, 21*b* that, for example, the central axis (that is, the axis of rotation) of the can 18 will be at a relatively small distance a from the rotary axis of the rotary coiler head 13. If subsequently a relatively thinner sliver (for example, made of cotton fibers) is to be handled by the coiler, after loosening the screws 21*b* (access thereto may be conventionally provided, for example, by sufficiently large apertures in the skirt portion of the base plate 19) the bearing assembly 21, 22, together with the base plate 19 is shifted to assume a greater distance b from the central axis of the can 18 and the axis of rotation of the rotary head 13. It may be observed in FIG. 2 that by increasing the distance from the two axes of rotation, the rotary head 13 (or more particularly, the rotary disc 16) has been moved to a more eccentric position with regard to the central axis of the can 18 and thus closer to the inner wall of the can 18. Thus, while in case of a relatively thick sliver an engagement of the sliver loops with the inner wall faces of the can 18 could be assured by a lesser eccentricity of the coiler head 16 from the axis of the can, with the readjusted position (increased eccentricity) thinner slivers will now also be deposited in such a manner that the sliver coils will be in engagement with the inner wall faces of the can 18 along their outermost zone. Thus, in both instances, an entire filling of the can 18 may be achieved as illustrated in FIG. 1*b*.

By means of a conventional adjustment of the tensioning roller 27 it may be ensured that the appropriate tension of the drive belt 26 is preserved in any adjusted position of the bracket 21 with respect to the foot plate 11.

It is to be noted that by providing that the adjusting screws 21*b* are readily accessible even during rotation (operation) of the base plate 19, the above-described adjustment parallel to the upper surface of the base plate 19 may be effected during operation to perform any necessary correction in the distance between the axis of rotation of the rotary head 13 and the central axis of the can 18.

Figure 4:
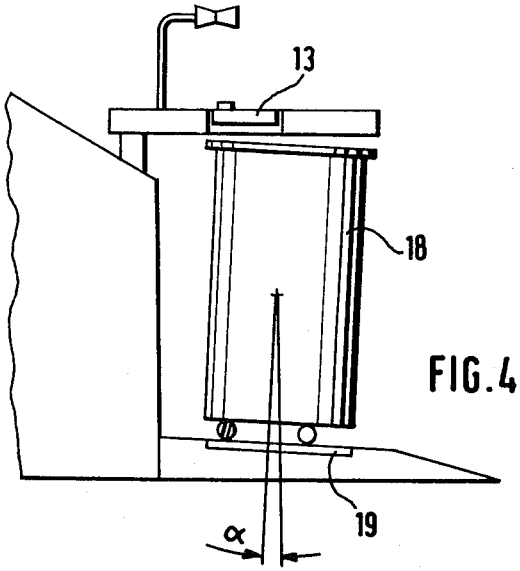
FIG. 4 is a schematic side elevational view of an inclined coiler incorporating the invention.
Figure 5:
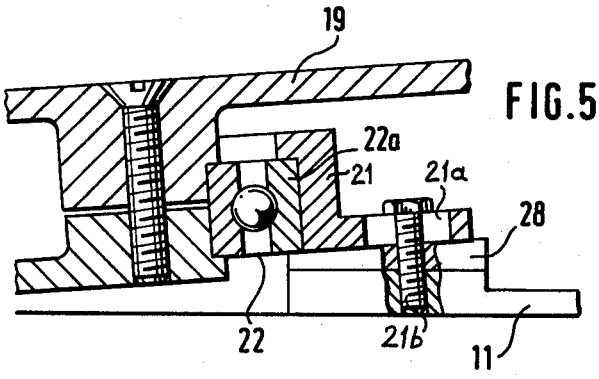
FIG. 5 is a fragmentary sectional elevational view of another preferred embodiment of the invention.

While in the embodiment according to FIG. 3, the adjustment is effected linearly in a direction parallel to the surface of the base plate 19, in another preferred embodiment of the invention illustrated in FIGS. 4 and 5, such distance adjustment may be effected by altering the angle between the central axis of the can 18 and the axis of rotation of the rotary head 13. For this purpose, between the foot plate 11 and the underside of the bracket 21 a cross-sectionally wedge-shaped insert 28, such as an annulus with the appropriate surface inclination may be positioned for adjusting the angular orientation of the base plate 19. As may be observed in FIG. 5, by providing the slot 21*a* in the securing flange of the bearing bracket 21 it is feasible to combine the two types of adjustments. The wedge plate 28 may have a thickness at its outer large end of about 2 to 5 mm.

The apparatus according to the invention may find use also in case individual cans have excessive dimensions or have a non-round configuration. The coiler according to the invention may be associated with a carding machine, a drawing frame, a combing machine or the like.

It will be understood that the above description of the present invention is susceptible to various modifications, changes and adaptations, and the same are intended to be comprehended within the meaning and range of equivalents of the appended claims.

What is claimed is:

1. In a sliver coiler including a can having an open top and a central axis; a support for positioning the can in a generally upright orientation; means for rotating said can about said axis on said support; a rotary head having an axis of rotation and guide means arranged eccentrically with respect to said axis of rotation, said central axis of said can being spaced from said axis of rotation of said rotary head, whereby during rotation of said rotary head and said can said rotary head deposits sliver in said can in superposed continuous circular coils being eccentric with respect to said central axis; the improvement comprising adjusting means for altering the angle between said central axis of said can and said axis of rotation of said rotary head for arbitrarily altering the distance between said central axis of said can and said axis of rotation of said rotary head for effecting contact between outer parts of said circular coils and inner wall faces of said can irrespective of the thickness of the sliver deposited in the coiler.

2. In a sliver coiler including a can having an open top and a central axis; a rotary base plate for positioning the can thereon in a generally upright orientation; means for rotating said rotary base plate about said axis; a stationary foot component; a bearing assembly rotarily supporting said base plate on said foot component; said bearing assembly including a bearing and a bearing bracket engaging and surrounding said bearing; a rotary head having an axis of rotation and guide means arranged eccentrically with respect to said axis of rotation, said central axis of said can being spaced from said axis of rotation of said rotary head, whereby during rotation of said rotary head and said can said rotary head deposits sliver in said can in superposed continuous circular coils being eccentric with respect to said central axis; the improvement comprising adjusting means for arbitrarily altering the distance between said central axis of said can and said axis of rotation of said rotary head for effecting contact between outer parts of said circular coils and inner wall faces of said can irrespective of the thickness of the sliver deposited in the coiler; said adjusting means including a mechanism for allowing shifting said base plate parallel to said surface and for immobilizing said base plate in its shifted position; said mechanism including a slot in said bearing bracket and a securing bolt passing through said slot and held in said foot component.

3. In a sliver coiler including a can having an open top and a central axis; a rotary base plate for positioning the can thereon in a generally upright orientation; means for rotating said rotary base plate about said axis; a rotary head having an axis of rotation and guide means arranged eccentrically with respect to said axis of rotation, said central axis of said can being spaced from said axis of rotation of said rotary head, whereby during rotation of said rotary head and said can said rotary head deposits sliver in said can in superposed continuous circular coils being eccentric with respect to said central axis; the improvement comprising adjusting means for altering the inclination of said base plate and for immobilizing said base plate in its adjusted inclined orientation for arbitrarily altering the distance between said central axis of said can and said axis of rotation of said rotary head for effecting contact between outer parts of said circular coils and inner wall faces of said can irrespective of the thickness of the sliver deposited in the coiler.

4. A sliver coiler as defined in claim 3, further comprising a stationary foot component, a bearing assembly rotarily supporting said base plate on said foot component, said bearing assembly including a bearing and a bearing bracket engaging and surrounding said bearing; said bearing bracket being supported on said foot component; said mechanism including an insert of wedge-shaped cross section positioned between an underside of said bracket and said foot component and a securing screw affixing said bearing bracket to said foot component.

5. In a sliver coiler comprising in combination (a) a can having an open top and a central axis;

(b) a support for positioning the can in a generally upright orientation;

(c) means for rotating said can about said axis on said support;

(d) a rotary head having an axis of rotation and guide means arranged at a predetermined distance from said axis of rotation, said central axis of said can being spaced from said axis of rotation of said rotary head, whereby during rotation of said rotary head and said can said rotary head deposits sliver in said can in superposed continuous circular coils of a diameter fixed by said predetermined distance and further whereby the coils are eccentric with respect to said central axis; and (e) adjusting means for arbitrarily altering the distance between said central axis of said can and said axis of rotation of said rotary head for effecting contact between outer parts of said circular coils and inner wall faces of said can irrespective of the thickness of the sliver deposited in the coiler.

6. A sliver coiler as defined in claim 5, wherein said adjusting means comprises means for allowing shifting of said can in a radial direction with respect to said central axis of said can.

7. A sliver coiler as defined in claim 5, wherein said support and said means for rotating said can comprises a rotary base plate having a surface for carrying said can; said adjusting means comprises a mechanism for allowing shifting said base plate parallel to said surface and for immobilizing said base plate in its shifted position.

* * * * *